US005484765A

United States Patent [19]

Dionne et al.

[11] Patent Number: 5,484,765

[45] Date of Patent: Jan. 16, 1996

[54] FERRITE/SUPERCONDUCTOR MICROWAVE DEVICE

[75] Inventors: Gerald F. Dionne, Winchester; Daniel E. Oates, Belmont, both of Mass.

[73] Assignee: Massachusetts Institute of Technology, Cambridge, Mass.

[21] Appl. No.: 192,174

[22] Filed: Feb. 4, 1994

[51] Int. Cl.[6] ..... H01P 1/19

[52] U.S. Cl. ..... 505/210; 505/211; 505/700; 505/866; 333/161; 333/99 S

[58] Field of Search ..... 333/161, 202, 333/204, 205, 219, 99 S; 505/210, 211, 700, 701, 866

[56] References Cited

U.S. PATENT DOCUMENTS

| | | | |
|---|---|---|---|
| 3,304,519 | 2/1967 | Weiss | 333/1.1 |
| 3,478,283 | 11/1969 | Simon et al. | 333/161 |
| 3,566,311 | 2/1971 | Buck | 333/161 |
| 4,152,676 | 5/1979 | Morgenthaler et al. | 333/204 X |
| 4,918,409 | 4/1990 | Lamberty | 333/99 S X |
| 5,153,171 | 10/1992 | Smith et al. | 333/161 X |

FOREIGN PATENT DOCUMENTS

| | | | |
|---|---|---|---|
| 174101 | 7/1989 | Japan | 333/204 |
| 101801 | 4/1990 | Japan | 333/204 |
| 4097602 | 3/1992 | Japan | 333/219 |

OTHER PUBLICATIONS

Malozemoff, A. P., "Superconducting Wire Gets Hotter," *IEEE Spectrum*, 26–30 (Dec., 1993).

Hansson, E. R. et al., "Planar Meanderline Ferrite–Dielectric Phase Shifter," *IEEE Transaction on Microwave Theory and Techniques*, vol. MTT–29, No. 3, 209–214 (Mar., 1981).

Weiss, J. A. et al., "New Uniaxial–Ferrite Millimeter Wave Junction Circulators", *IEEE MTT–S Digest*, 145–148 (1989).

Weiss, J. A. et al., "New Self Biased Circulators," *Applied Microwave*, 74–85 (Fall, 1990).

Denlinger, E., et al., "Superconducting Nonreciprocal Devices for Microwave Systems," *IEEE Microwave and Guided Wave Letters*, 2(11):449–451 (Nov., 1992).

*Primary Examiner*—Benny T. Lee

*Attorney, Agent, or Firm*—Hamilton, Brook, Smith & Reynolds

[57] ABSTRACT

An apparatus and method are described for gyromagnetic interaction between the electromagnetic field generated by an electromagnetic signal conducted by a superconductor and the magnetization contained in a magnetic structure. A ferrite magnetic structure is disposed in close proximity to a superconductor conducting the electromagnetic signal. A magnetization is induced in the magnetic structure with a geometry such that the magnetic flux is confined within the magnetic structure or eliminated from the magnetic structure so as not to produce an external magnetic field to interfere with the superconducting properties of the superconductor. The electromagnetic field of the signal conducted by the superconductor interacts gyromagnetically with the magnetization of the magnetic structure, inducing a phase shift in the electromagnetic signal traversing the superconductor. Thus, the invention induces a phase shift in the signal with minimum insertion loss due to electrical resistance.

7 Claims, 6 Drawing Sheets

FERRITE/SUPERCONDUCTOR MICROWAVE DEVICE

GOVERNMENT SUPPORT

The Government has rights in this invention pursuant to Contract Number F 19628-90-C-0002, awarded by the United States Department of the Air Force.

BACKGROUND OF THE INVENTION

It is well known that the phenomenon of superconductivity is destroyed by raising the temperature of a superconducting material above its critical temperature $T_c$. It is also well known that by exposing a superconductor to a magnetic field or by applying too strong a current density, a superconductor will lose its superconducting properties. The threshold current density $J_c$ and the threshold magnetic field $H_c$ (also known as the critical current density and critical magnetic field) necessary for destroying superconductivity at a temperature below $T_c$ have been found to be a function of temperature. That is, as the temperature of a superconductor is lowered below its critical temperature $T_c$, the critical current density $J_c$ and critical magnetic field $H_c$ increase in magnitude. Thus, as the temperature is lowered, the superconductor is capable of conducting increased electrical current and may be exposed to a stronger magnetic field without adversely impacting its superconducting properties.

A superconducting material with a relatively high critical temperature $T_c$ will exhibit a high critical current density $J_c$ and high critical field $H_c$. Also, a material with a higher critical temperature $T_c$ requires less cryogenic support to obtain the same performance in comparison to low $T_c$ materials. Modern research has yielded superconducting materials with reported critical temperatures $T_c$ reaching 160 Kelvin. As scientific research yields superconducting materials with ever increasing critical temperatures, the potential for practical applications for superconductors increases with the ultimate goal being superconductor technology at room temperature.

A ferrite is an iron oxide-based material that combines dielectric properties with an internal magnetization that is created when it is energized by an externally applied magnetic field. Magnetic media such as ferrites are composed of ions which possess microscopic magnetic dipoles. Ordinarily the dipoles are randomly oriented so that the bulk magnetic properties are weak or absent. When a magnetic specimen is immersed in an externally applied magnetic field H, the dipoles tend to align with the magnetic field H, and the interior of the material takes on a resultant magnetic moment density or magnetization M. The vector combination of H and M is the magnetic flux (density) B. The concept of magnetic flux implies two components, one from an external magnetic field and the other from an internal magnetization, with either or both being present at any time.

Depending on the particular shape of the magnetic structure, magnetic dipoles may point perpendicular to the surface of the structure, giving rise to north and south magnetic poles. The poles act as sources of an induced magnetic field generally distributed both inside and outside of the structure. Since the internal induced field is directed opposite to the magnetization, the magnetization will be generally reduced in the ferrite after the applied field is removed, but the remaining (remanent) magnetization becomes a magnetic source that can generate an external magnetic field that can invade other structures such as a superconductor circuit in proximity to said magnetic structure.

Ferrite phase shifters using conducting microstrip meanderline techniques have been developed for several years. A standard ferrite-dielectric phase shifter includes a coupled microstrip meanderline fed by straight 50Ω feed lines. The meanderline, comprised of a standard conducting material such as copper, is deposited on a ferrite substrate which is magnetized in the direction of the meanderline elements. The gyromagnetic coupling between the magnetization of the ferrite and the magnetic field of the electromagnetic wave surrounding the meanderline conducting the microwave signal causes a phase shift of an amount proportional to the magnetization of the ferrite in the microwave signal traversing the meanderline.

The unit of efficiency for a phase shifter is known as the Figure of Merit ("FOM") which represents the differential phase shift in degrees induced in the electromagnetic wave conducted by the meanderline divided by the device insertion loss in decibels ("dB"). The differential phase shift is the change in phase that occurs when the direction of the magnetization is reversed. Several factors contribute to insertion loss, including: conductor resistance, gyromagnetic relaxation, and polaronic conductivity in the ferrite. Copper-based meanderline phase shifters in a frequency band from 5 to 6 GHz have been developed with a FOM on the order of 300 deg/dB as reported in:

Hansson, et al., "Planar Meanderline Ferrite-Dielectric Phase Shifter", IEEE Transactions on Microwave Theory and Techniques, Vol. MTT-29, No. 3, 208–215, (March, 1981).

For the copper-based meanderline phase shifter design tested in the aforementioned Hansson article, the insertion loss was on the order of 2.0 dB, rendering the device impractical for many applications.

Scientists have experimented with replacing copper-based conductors with superconductors for application in ferrite microwave devices. One such study is reported in:

Denlinger, E. et al., "Superconducting Nonreciprocal Devices for Microwave Systems", IEEE Microwave and Guided Wave Letters, Vol. 2, No. II, 449–451 (November, 1992).

The study compared two Y-junction nonresonant microwave ferrite circulator designs, one employing a copper conductor and the other employing a superconductor. The stripline circulator design comprised a circular center conductor disposed between two ferrite disks magnetized by the magnetic field of an external magnet. The insertion loss of the copper device was 0.46 dB and the peak isolation was 25.3 dB at 77 Kelvin. For the superconductor sample, YBCO film was deposited on a dielectric substrate. YBCO is a high temperature superconductor with a critical temperature, $T_c$, greater than 77 Kelvin. The insertion loss of the YBCO sample was 0.49 dB and the peak isolation was 34.1 dB at 77 Kelvin. Note that the insertion loss for the YBCO superconductor-based sample was slightly higher than the insertion loss for the copper-based sample. This was at least partly due to the magnetic field of the external magnet that invaded the superconductor and degraded the superconducting properties of the superconductor. Thus, the superconductor-based sample offered no significant improvement over the copper-based sample, and in fact had a higher insertion loss.

SUMMARY OF THE INVENTION

The present invention is directed to an apparatus and method for obtaining phase shift with low insertion loss in an electromagnetic wave signal conducted by a superconductor. The apparatus of the invention comprises a superconductor for conducting the electromagnetic wave and a magnetized structure disposed in close proximity with the superconductor. Magnetic flux is confined within or eliminated from the magnetic structure. The magnetization interacts gyromagnetically with the magnetic field component of the electromagnetic wave extending into the magnetic structure, causing phase shift in the electromagnetic wave for a wave in the nonresonant spectrum or absorption of the electromagnetic wave for a wave in the resonant spectrum.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

The origin of the external magnetic fields generated by a magnetized ferrite structure is the magnetic poles of the magnetization that are induced on the surfaces of the structure after the energizing field is removed. The strengths of the magnetic fields depend on the geometrical shape of the ferrite. External magnetic fields may be eliminated or made negligible by either of two choices of magnetic structure geometry. In the ideal case of a toroidal or closed magnetic path, there are no surfaces perpendicular to the magnetization and no induced magnetic poles to produce either an internal or an external field when the magnetic flux is confined within the magnetic structure. In the opposite extreme of a flat plate or disk magnetized perpendicular to its faces, a high density of poles exists on each face, creating a large demagnetizing field that is equal in strength and opposite in direction to the magnetization, thereby eliminating the magnetic flux within the disk and the magnetic field external to the disk. Since Maxwell's equation states that the divergence of the magnetic flux density vector equals zero, $\Delta \cdot B=0$, there is no significant external magnetic field H in either case because B does not exit the magnetized toroid, and $B \simeq 0$ in the thin magnetized disk. Where a coercive magnetic field, which is the threshold magnetic field required to switch the magnetization direction in the structure, is greater than the demagnetizing field from the poles, the magnetization remains undisturbed. This condition is called "self biasing", as described in:

Weiss, J. A., Watson, N. G. and Dionne, G. F., "New Self Biased Circulators," Applied Microwave, 74–85 (Fall, 1990)

A ferrite is also a gyrotropic medium that can influence the propagation of an electromagnetic wave or signal. At high frequencies, including the microwave and millimeter-wave bands, a gyromagnetic interaction occurs between the magnetization of the ferrite and the magnetic field component of the electromagnetic wave traversing the ferrite. At a specific frequency, the interaction becomes resonant and the electromagnetic wave is absorbed by the ferrite across a narrow band about the resonance frequency. At frequencies away from the gyromagnetic resonance condition, the absorption becomes negligible but a phase shift remains in the wave. The absorption effect is the basis for filter devices and resonant isolators (resonant devices), and the phase shift effect is the basis for phase shifters and circulators (non-resonant devices).

Figure 1:
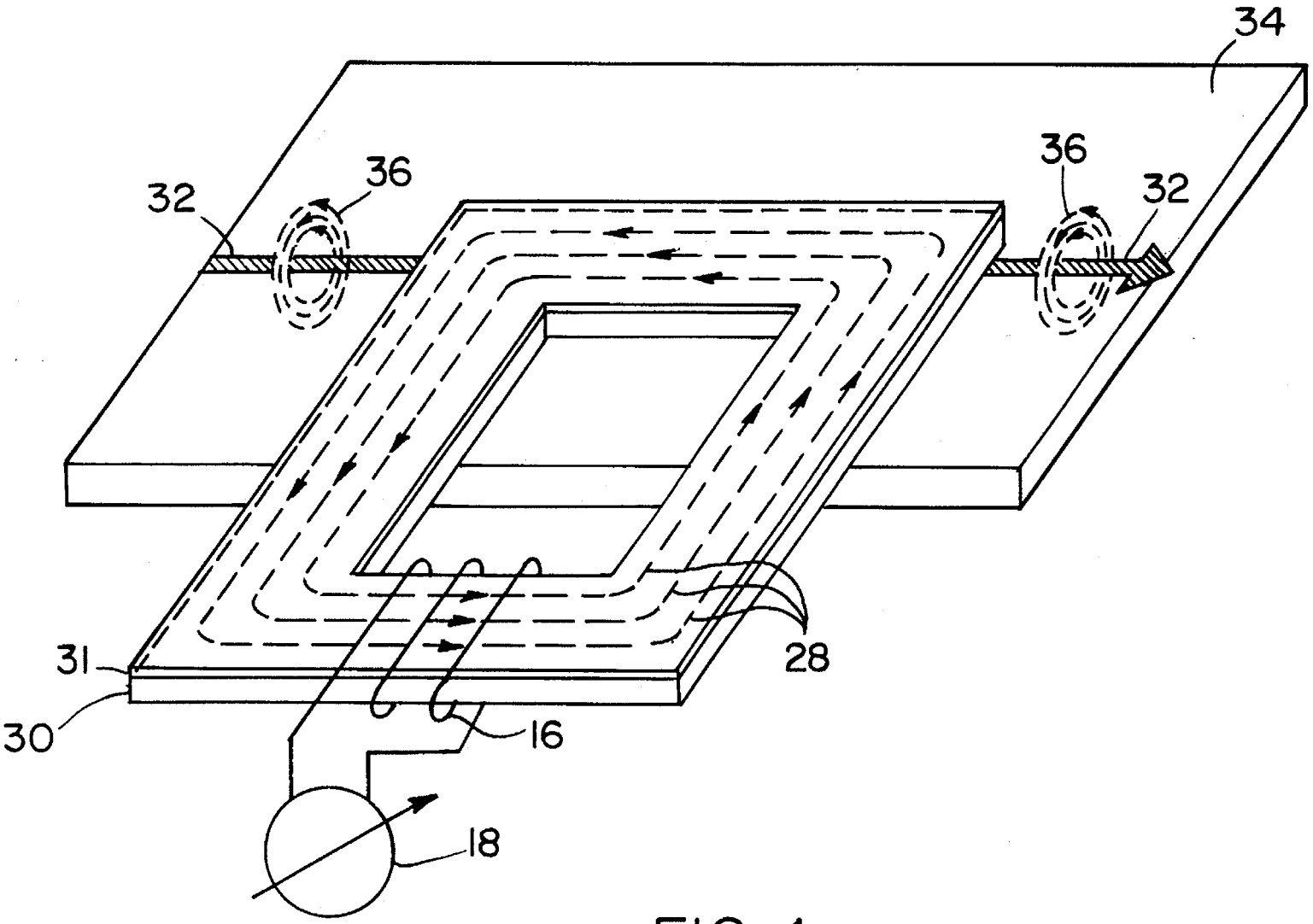
FIG. 1 is a perspective view of phase shift apparatus in accordance with the present invention, comprising a superconducting planar transmission line circuit deposited on a dielectric substrate, the superconducting line being in pressure contact with one side of a window-frame toroidal magnetized ferrite structure.

FIG. 1 schematically illustrates an apparatus of the invention which uses the above referenced properties of ferrite materials to produce a phase shifter with an exceptionally high FOM. The apparatus of FIG. 1 induces reciprocal phase shift in an electromagnetic wave, which is traversing a planar transmission line of superconductor material disposed in close proximity to a magnetized structure. A superconductor 32, such as niobium (Nb), is formed on a dielectric substrate 34, such as sapphire. One side of a window-frame type toroidal magnetic structure 30, comprised of ferrimagnetic material, such as Yttrium Iron Garnet (YIG), is in pressure contact with the superconductor 32. A wire coil 16 encircles the frame of the toroidal magnetic structure 30. A power supply 18 provides a current for the wire coil 16, inducing a magnetic field 28 in the toroidal magnetic structure 30. The strength and direction of the magnetic field 28 induced in the toroidal magnetic structure 30 is a function of the number of coil windings 16 and the strength and polarity of the current supplied by the power supply 18. The magnetic field applied by the coil magnetizes the magnetic structure by aligning its magnetic dipoles to form a resultant magnetization that produces additional magnetic flux which remains after the magnetic field induced by the coil current is removed. Note that for purposes of the invention, the term "toroid" when used to describe the shape of magnetic structures, includes any continuous, closed-loop structure within which magnetic flux is substantially confined.

As a microwave signal traverses the superconductor 32, an electromagnetic field 36 is established. The electromagnetic field 36 surrounds the superconductor 32, permeating the toroidal magnetic structure 30. The electromagnetic field 36 of the superconductor 32 interacts gyromagnetically with the magnetization 28 of the toroidal magnetic structure 30, causing the phase of the signal traversing the superconductor 32 to shift in proportion to the strength of the interaction. Because the magnetic flux 28 is confined almost entirely within the toroidal magnetic structure 30, almost none of the magnetic flux 28 permeates the superconductor 32, preserving its superconducting properties. Thus, a phase shift is induced in the signal conducted by the superconductor 32 without adversely affecting the superconductor's advantageous reduced insertion loss due to electrical resistance. The face of the toroidal magnetic structure 30 opposite the superconductor 32 is coated with a conductor 31, for example silver, creating a ground plane for intensifying within the ferrite the magnetic fields of the electromagnetic wave conducted by the superconductor for the purpose of increasing the gyromagnetic interaction between the magnetization 28 of the toroidal magnetic structure 30 and the magnetic field of the electromagnetic wave extending into the toroid.

Insertion loss in a ferrite phase shifter is a function of gyromagnetic relaxation, polaronic conductivity in the ferrite, and conductor resistance. At millimeter wavelengths, the signal path length is prevented from being shortened in proportion to the reduced wavelength by the limited magnetization of ferrite at room temperature. At room temperature, the maximum available saturation magnetization of ferrites is approximately 5,000 Gauss. At lower temperatures, all of the listed limitations improve, particularly the conduction losses which are much reduced over those of normal conductors.

Since their discovery in 1986, one main thrust in the development of high temperature superconductors has been for electronic applications. As a consequence, emphasis on microwave applications at a temperature T=77 Kelvin (the boiling point of liquid nitrogen) has grown steadily as surface resistances have improved with refinement of film deposition techniques. Recent films of YBCO have featured surface resistances superior to conventional copper at frequencies (f) below 100 GHz, with the superconductor advantage increasing by a factor of $f^{3/2}$ as the frequency decreases into the microwave bands.

Figure 2A:
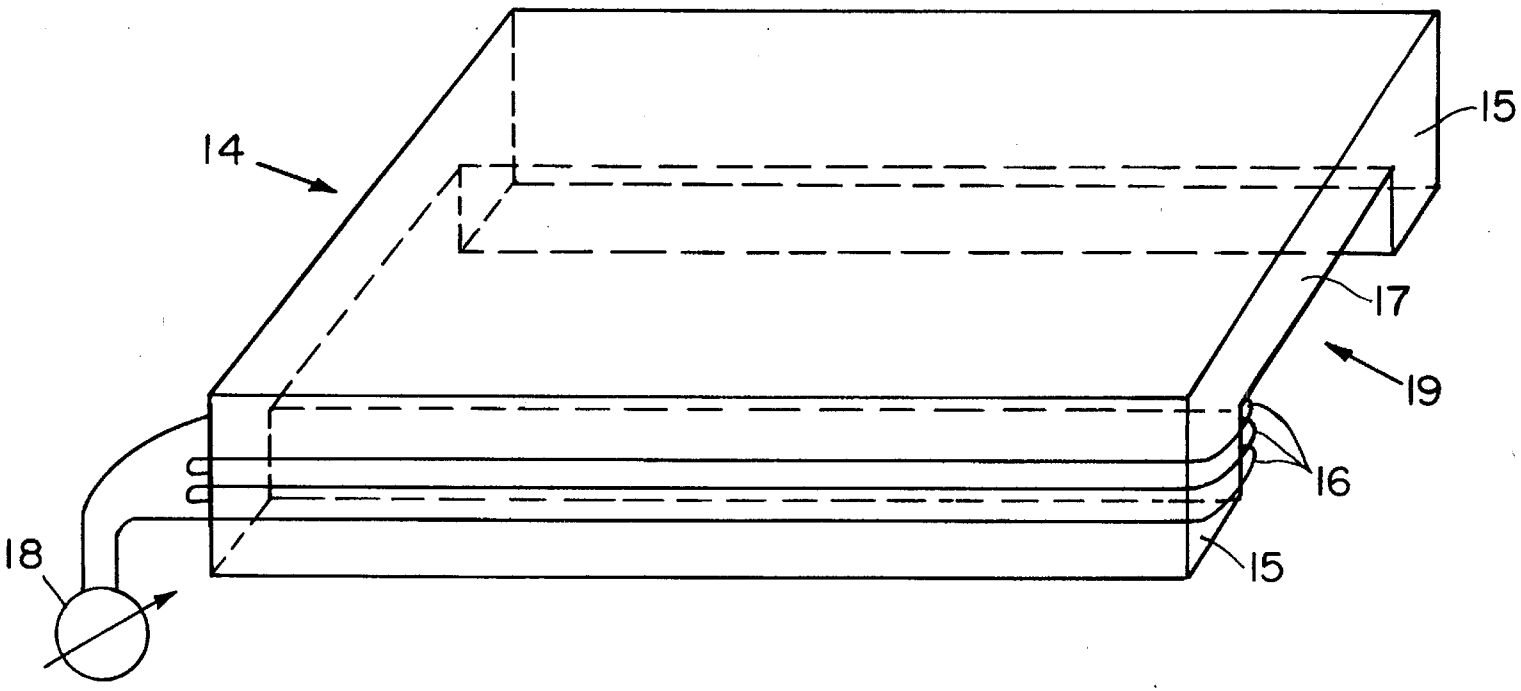
FIGS. 2A, and 2B provide an exploded perspective view of the meanderline superconductor ferrite phase shifter illustrated in FIG. 3.
Figure 2B:
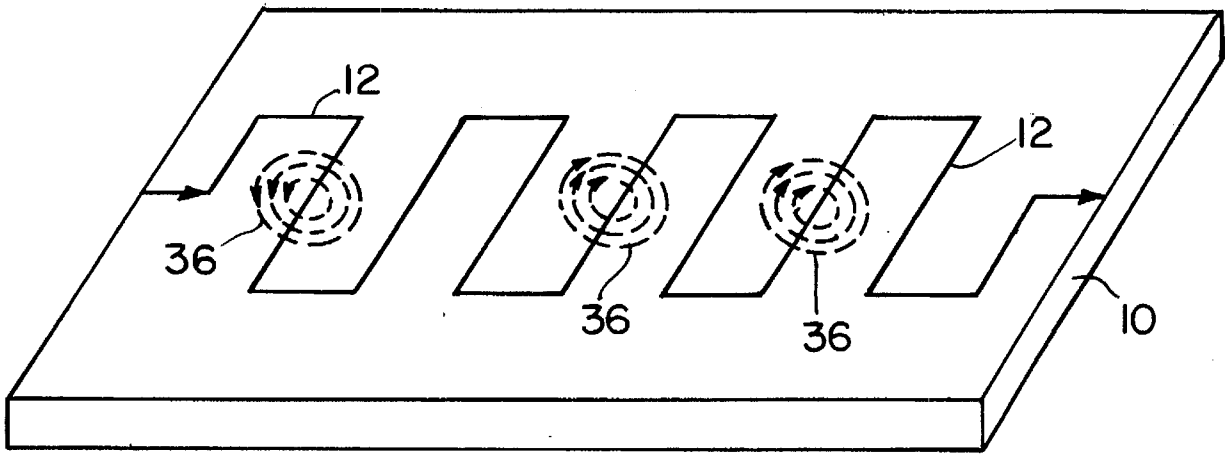
Figure 3:
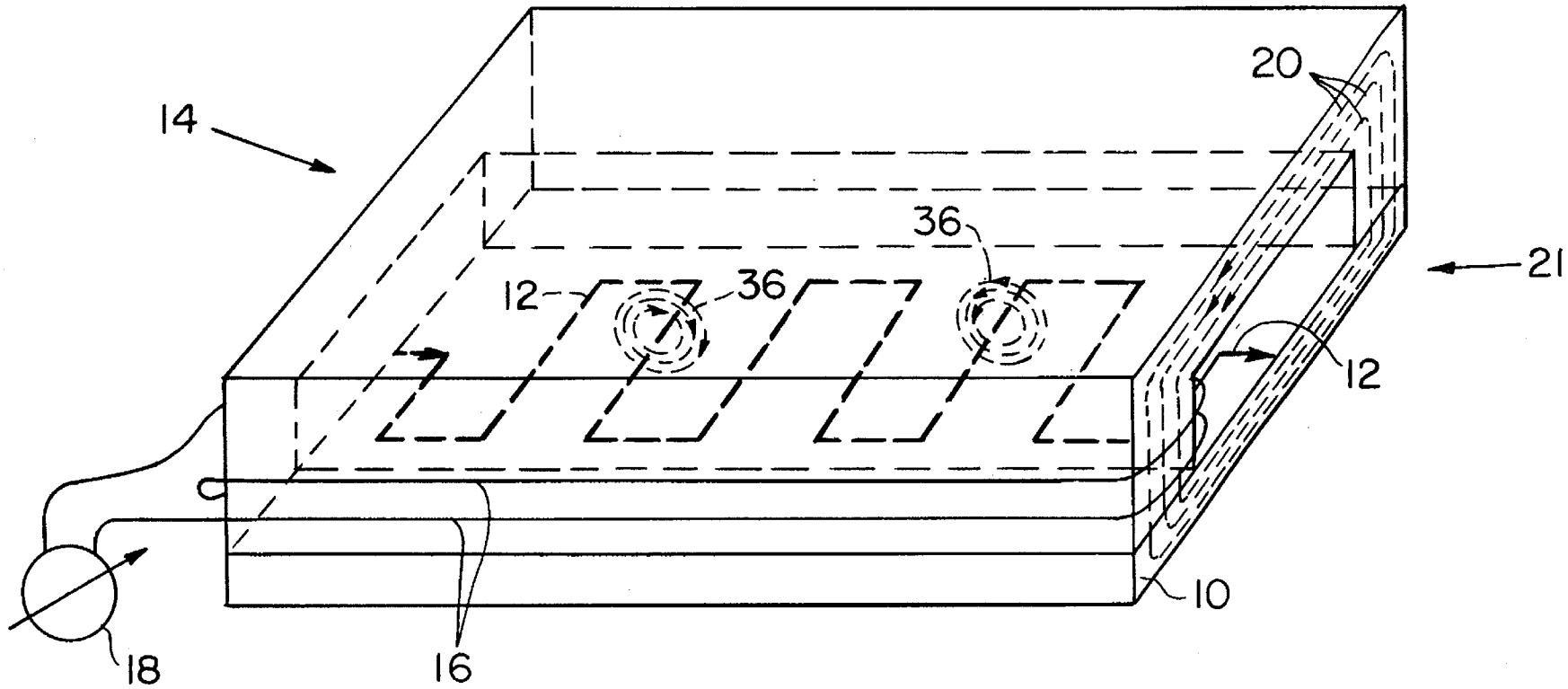
FIG. 3 is a perspective view of a meanderline superconductor ferrite phase shifter wherein a superconducting meanderline circuit for conducting current is deposited on a ferrite substrate forming one side of a rectangular toroidal magnetic structure, illustrating an embodiment of the present invention.

FIGS. 2A and 2B provide an exploded perspective view of a meanderline superconductor phase shifter of FIG. 3 embodying the present invention. This configuration produces nonreciprocal phase shift, in contrast to the device of FIG. 1 which is a reciprocal phase shifter. A superconducting meanderline circuit 12 is formed on a rectangular magnetic substrate 10, such as ferrite, as shown in FIG. 2B. A microwave signal traversing the superconductor meanderline 12 induces an electromagnetic field 36 which surrounds the meanderline 12 and permeates the ferrite substrate 10.

As shown in FIG. 2A, a ferrite member 14 comprised of two vertical walls 15, a connecting planar wall 17, and an open bottom 19 is formed. A wire coil 16 encircles the ferrite member 14 a multitude of times. A power source 18 is provided to energize the coil 16.

The ferrite member 14 is pressed onto the ferrite base 10 and may be secured by means of a low temperature adhesive, forming a rectangular toroidal magnetic structure 21, as shown in FIG. 3. The power source 18 energizes the wire coil 16, inducing a magnetic field 20 in the magnetic structure 21. After magnetizing the magnetic structure, the power source 18 may be removed. The direction and strength of the magnetic field 20 is dependent on the polarity and magnitude of current supplied by the power source 18, and the number of coil windings 16. Due to the toroidal shape of the magnetic structure 21, the magnetic flux 20 of the applied field and the magnetization are confined almost entirely within the toroidal magnetic structure 21.

The electromagnetic field 36 of a signal traversing the meanderline superconductor 12, permeates the ferrite substrate 10, interacting gyromagnetically with the magnetization 20 induced in the toroidal magnetic structure 21. The interaction causes a phase shift in the signal traversing the superconductor 12. The sign of the phase shift is determined by the direction of the current in the energizing coil which determines the direction of the magnetization. Because the magnetic flux 20 is confined almost entirely within the toroidal magnetic structure 21, none of the magnetic flux 20 permeates the meanderline superconductor 12, thereby avoiding deterioration of its superconducting properties.

Experiments have been conducted on the configuration illustrated in FIG. 3. The meanderline conductor 12 consisted of niobium (Nb), which is a superconductor with a critical temperature of 9 Kelvin. The apparatus was cooled to 4 Kelvin, and a magnetic field was induced in the magnetic structure, which comprised ferrite. Microwave signals ranging in frequency from 10 to 15 Ghz exhibited 700 degrees of differential phase shift between magnetization states of opposite direction. The insertion loss of the device was measured to be less than 0.5 dB. Thus, the configuration produced a microwave phase shifter exhibiting a figure of merit greater than 1,400 deg/dB. Higher figures of merit are expected for more accurately calibrated embodiments. Similar results are expected for higher temperature superconductors, such as YBCO, which has a critical temperature of about 90 Kelvin, and therefore, may be cooled with liquid nitrogen to 77 Kelvin, and eventually for superconductors with critical temperatures above 300 Kelvin (room temperature).

Figure 4A:
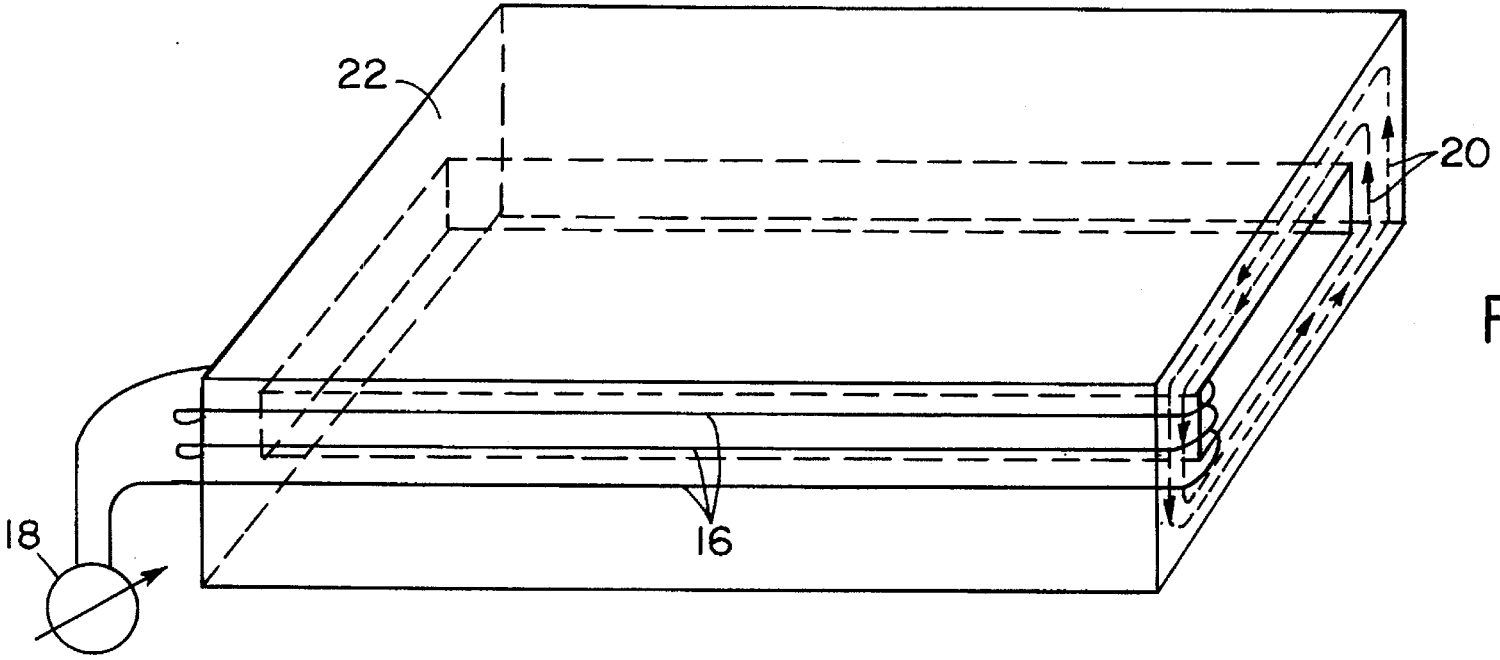
FIGS. 4A and 4B provide an exploded perspective view of the meanderline superconductor ferrite phase shifter illustrated in FIG. 5.
Figure 4B:
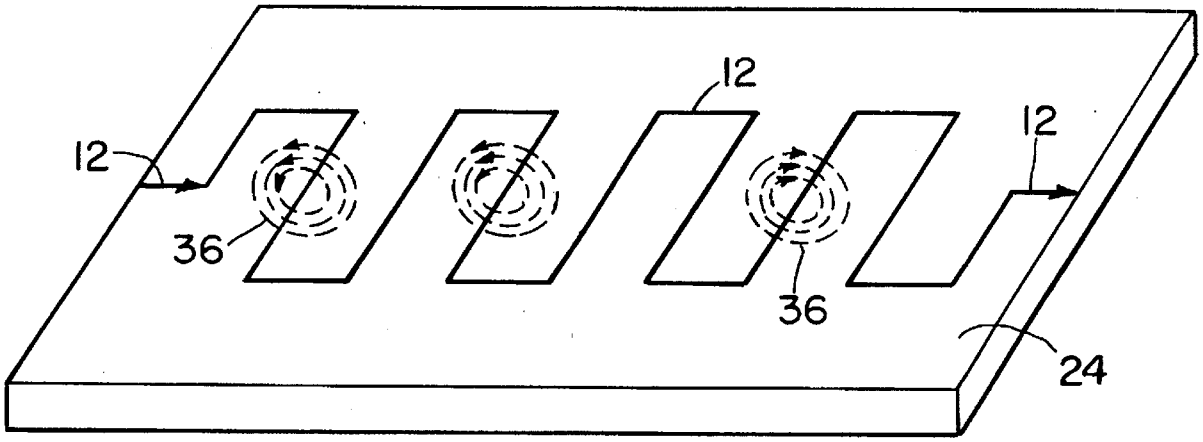
Figure 5:
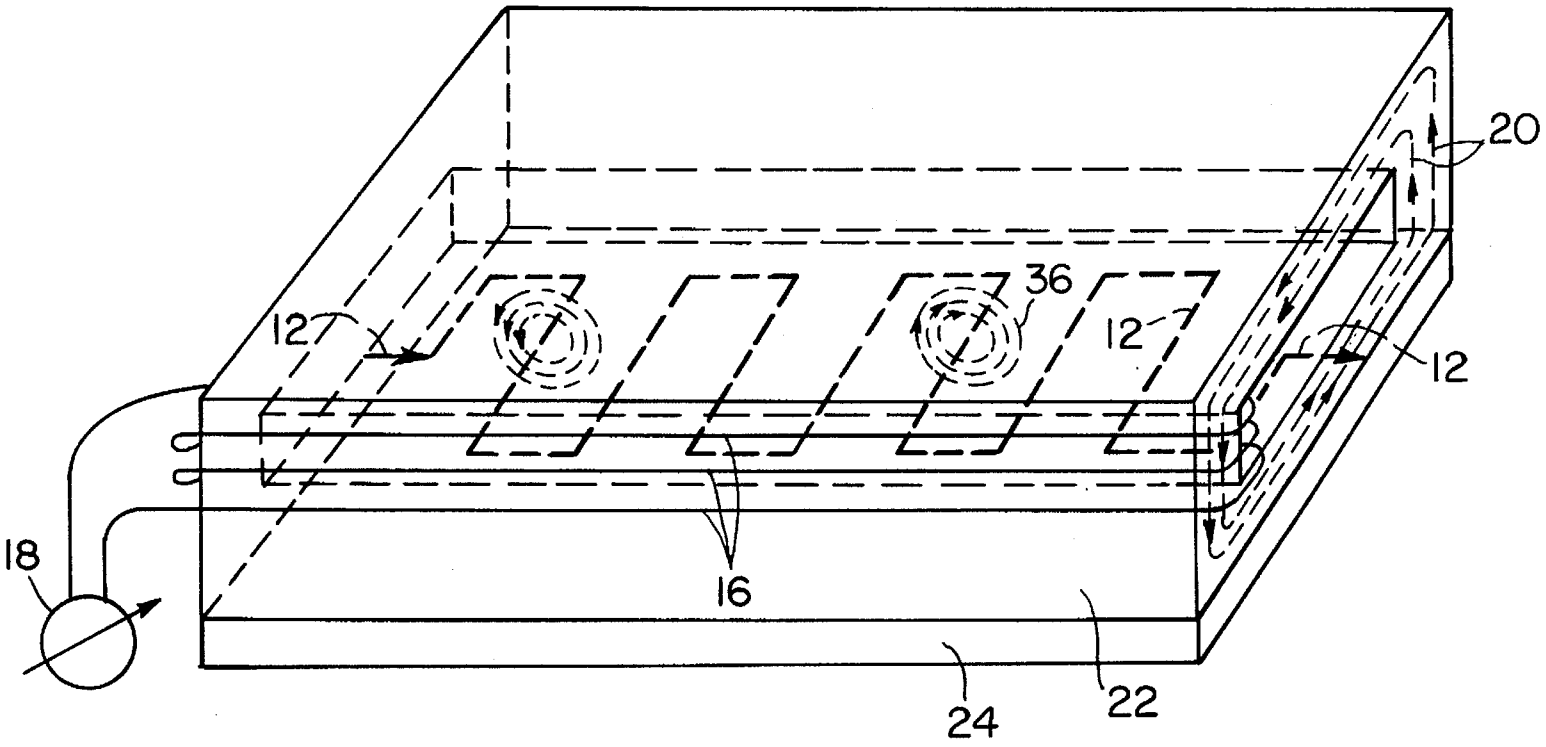
FIG. 5 is a perspective view of a meanderline superconductor phase shifter wherein a superconducting meanderline circuit for conducting current is deposited on a dielectric substrate which in turn is bonded or placed in proximity to one side of a rectangular toroidal magnetized ferrite structure, illustrating an embodiment of the present invention.

FIGS. 4A and 4B provide an exploded perspective view of the embodiment of a meanderline phase shifter shown in FIG. 5 which is similar to the embodiment of FIG. 3 but allows a superconductor meanderline 12 to be formed on a dielectric substrate 24. As shown in FIG. 4B, a microwave signal traversing the superconductor meanderline 12 creates an electromagnetic field 36 which surrounds the meanderline 12.

As shown in FIG. 4A, a rectangular toroid 22 is formed of a magnetic material with electrical insulating properties, such as ferrite. A wire coil 16 encircles the toroidal magnetic structure 22 and a power source 18 induces a current in the wire coil 16. The coil current applies a magnetic field 20 in the toroidal magnetic structure 22, the direction and strength of which is a function of the number of coil windings 16 and the strength and polarity of the current from the power supply 18. The magnetic field applied by the coil also magnetizes the magnetic structure by aligning its magnetic dipoles to produce a resultant magnetization and additional magnetic flux which remain after the magnetic field applied by the coil current is removed.

As shown in FIG. 5, the toroidal magnetic structure 22 is disposed above the superconducting circuit 12 and is bonded to or pressed against the dielectric substrate 24. A wire coil 16 encircles the toroidal magnetic structure 22 as shown. A power source 18 provides a current in the coil 16 inducing a magnetic field 20 that induces a magnetization in the toroidal magnetic structure 22. The electromagnetic field 36 of the microwave signal traversing the superconductor 12 permeates the underside of the toroidal magnetic structure 22, interacting gyromagnetically with the magnetization in the magnetic structure 22, inducing a phase shift in the signal traversing the superconductor 12. Because the magnetic field flux 20 is confined almost entirely within the toroidal magnetic structure 22, the magnetic field flux 20 does not permeate the superconductor 12. Therefore the superconducting properties of the superconductor are preserved.

Figure 6B:
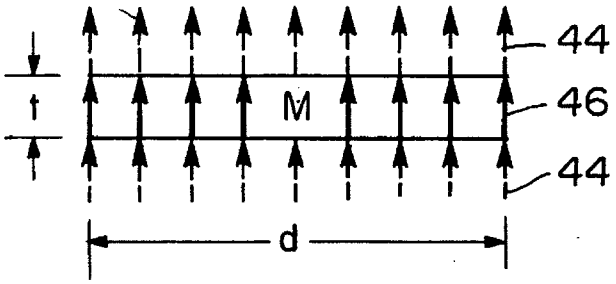
FIG. 6B is a cross-sectional view of the magnetized ferrite disk of FIG. 6A, illustrating the theory supporting its operation.
Figure 6A:
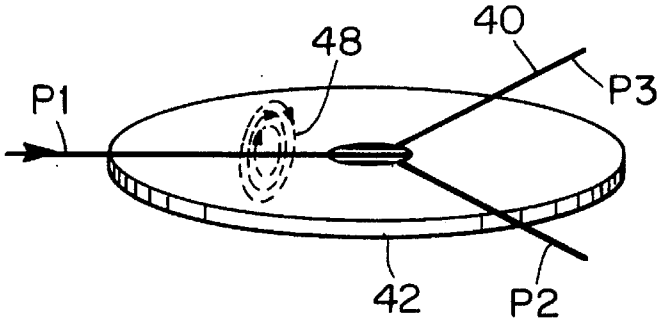
FIG. 6A is a perspective view of a ferrite-superconductor Y-junction circulator wherein a superconducting circuit is deposited on a thin magnetically self-biased uniaxial ferrite disk, illustrating an embodiment of the invention.

FIG. 6A illustrates an application of the present invention in the form of a Y-junction nonresonant ferrite circulator. A superconducting circuit 40 is deposited on a thin ferrite disk 42. The ferrite disk 42 is comprised of magnetically self-biased uniaxial ferrite or a thin permanent magnet with a thin ferrite layer. A microwave signal traversing the superconductor 40 creates an electromagnetic field 48 which surrounds the superconductor 40, permeating the ferrite disk 42.

The magnetic field 48 of the electromagnetic wave interacts gyromagnetically with the magnetization aligned perpendicular to the surface of the ferrite disk 42, which causes the propagation constant of the wave entering the superconductor 40 at one port P1 to exit unattenuated from a second port P2. The nonreciprocal action of the circulator device is realized when a signal returning through the second port P2 fails to exit the original entry port P1, but instead exists the third port P3.

As illustrated in FIG. 6B, the magnetic flux 46 is confined almost entirely within the disk, thereby avoiding deterioration of the superconducting properties of the superconductor 40. The magnetic field external to the disk 44 is cancelled by the demagnetizing field from magnetic poles on opposite disk surfaces. The external magnetic field is proportional to the magnetization multiplied by the thickness of the disk t divided by the diameter of the disk d:

$$H_{external} \alpha M_{internal} * t/d,$$

where $H_{external}$ is the magnetic field external to the disk, and $M_{internal}$ is the internal magnetization vector. As the ratio of the thickness of the disk t to the diameter of the disk d approaches zero, the external magnetic field 44 likewise approaches zero. Thus, for a thin disk 42, the magnetization vector M within the disk is directed normal to the disk surface and the external magnetic field 44 is substantially eliminated. The electromagnetic field 48 of a signal traversing the superconductor circuit 40 interacts gyromagnetically with the magnetization 46 of the self-biased uniaxial disk 42, producing the desired nonreciprocal circulator effect, without degrading the superconducting properties of the superconductor material 40.

Figure 7B:
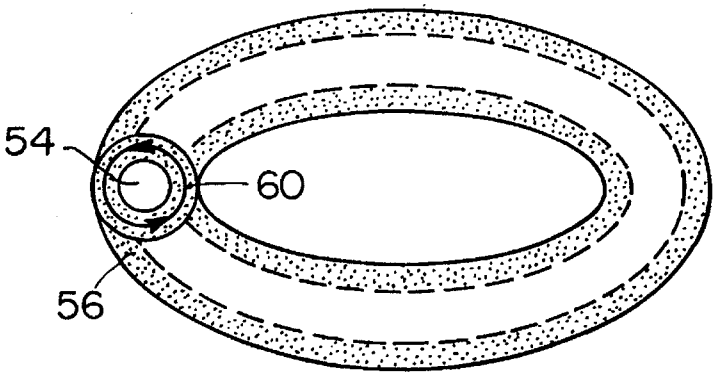
FIG. 7B is a perspective view of a composite wire coil configuration of the present invention wherein the superconducting core is contained by a magnetized ferrite sheath with confined magnetic flux.
Figure 7A:
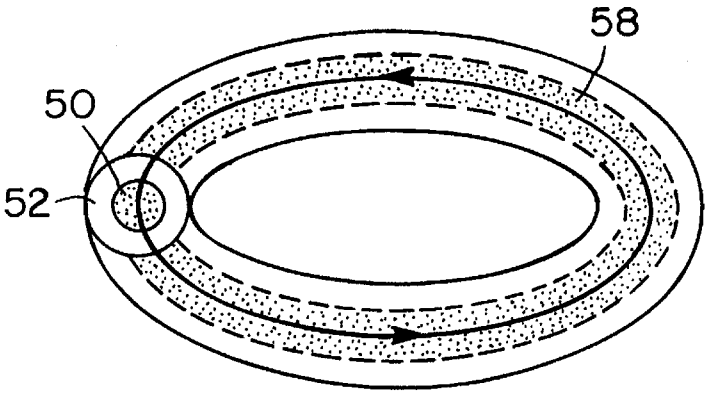
FIG. 7A is a perspective view of a composite wire coil configuration of the present invention wherein a magnetized ferrite core with confined magnetic flux is contained by a superconducting sheath.

FIG. 7A and FIG. 7B illustrate an embodiment of the invention applied in composite wire coil configurations. As described in:

Malozemoff, A., "Superconducting Wire Gets Hotter", IEEE Spectrum, pp. 26–30 (December, 1993).

with rising critical temperatures for superconductors, superconducting wires have increasing applications in magnetic and electric power equipment.

In FIG. 7A, a ferrite magnetic core 50 is enclosed by a superconductor sheath 52 and formed in the shape of a wire. The magnetic flux 58 is confined almost entirely within the magnetic core 50, and thus, the magnetization may interact gyromagnetically with the electromagnetic field of the signal conducted by the superconducting sheath 52 without hindering its superconducting properties, causing phase shift of the signal in the nonresonant condition.

In FIG. 7B, a superconductor core 54 is surrounded by a magnetic sheath 56. A magnetic flux 60 induced in the magnetic sheath 56, is confined within the toroid created in the magnetic sheath 56. Thus, gyromagnetic interaction of the magnetization 60 of the sheath 56 and the electromagnetic field of the signal conducted by the wire 54 occurs without adversely affecting the superconducting properties of the core 54, causing phase shift of the signal in the nonresonant condition.

Any of the popular superconductor materials may be used for purposes of the invention. These materials include: $YBa_2Cu_3O_7$, $Bi_2Sr_2Ca_{n-1}Cu_nO_{2n+4+\delta}$, $Tl_2Sr_2Ca_{n-1}Cu_nO_{2n+4+\delta}$ and $HgSr_2Ca_{n-1}Cu_nO_{2n+2+\delta}$.

where n is an integer greater than or equal to 1 and δ is a positive or negative integer for defining variation in the concentration of Oxygen.

While this invention has been particularly shown and described with references to preferred embodiments thereof, it will be understood by those skilled in the art that various changes in form and details may be made therein without departing from the spirit and scope of the invention as defined by the appended claims.

We claim:

1. An electromagnetic device comprising:

a) a superconductor for conducting an electromagnetic signal applied thereto, said signal having an electromagnetic field; and b) a magnetic structure having a magnetization; said magnetization producing a magnetic flux which is substantially confined within said magnetic structure so that said magnetic flux does not substantially permeate said superconductor; said magnetic structure being in sufficient proximity to said superconductor such that said electromagnetic field of said electromagnetic signal permeates said magnetic structure and interacts with said magnetization to produce frequency dependent effects upon said electromagnetic signal.

2. The device of claim 1 wherein said electromagnetic signal conducted by said superconductor is of frequency in a range between about 1 GHz to about 100 GHz.

3. The device of claim 1 wherein said frequency dependent effects comprise phase shift of said electromagnetic signal.

4. The device of claim 1 wherein said magnetic structure is a magnetized toroid.

5. The device of claim 1 wherein said magnetic structure comprises a closed loop of ferrite material.

6. A method comprising the steps of:

a) propagating an electromagnetic signal having an electromagnetic field through a superconductor;

b) inducing a magnetization in a magnetic structure; said magnetization producing a magnetic flux which is confined within said magnetic structure so that said magnetic flux does not substantially permeate said superconductor; and c) disposing said magnetic structure in sufficient proximity with said superconductor such that said electromagnetic field of said electromagnetic signal permeates said magnetic structure and interacts with said magnetization to produce frequency dependent effects upon said electromagnetic signal.

7. The method of claim 6 wherein said frequency dependent effects comprise phase shift of said electromagnetic signal.

* * * * *

UNITED STATES PATENT AND TRADEMARK OFFICE

CERTIFICATE OF CORRECTION

PATENT NO. : 5,484,765

DATED : January 16, 1996

INVENTOR(S) : Gerald F. Dione and Daniel E. Oates

It is certified that error appears in the above-identified patent and that said Letters Patent is hereby corrected as shown below:

Column 8, line 26 after "superconductor" delete "for".

Signed and Sealed this

Sixteenth Day of April, 1996

Bruce Lehman

*Attest:*

BRUCE LEHMAN

*Attesting Officer*

*Commissioner of Patents and Trademarks*